US009668932B2

(12) United States Patent
Mansur, Jr. et al.

(10) Patent No.: US 9,668,932 B2
(45) Date of Patent: Jun. 6, 2017

(54) PORTABLE MICRO AIR PUMP FOR USE IN INTERMITTENT PNEUMATIC COMPRESSION THERAPY

(71) Applicant: Compression Therapy Concepts, Inc., Eatontown, NJ (US)

(72) Inventors: Orlando Mansur, Jr., Eatontown, NJ (US); Leonard Nass, Eatontown, NJ (US)

(73) Assignee: Compression Therapy Concepts, Inc., Eatontown, NJ (US)

( * ) Notice: Subject to any disclaimer, the term of this patent is extended or adjusted under 35 U.S.C. 154(b) by 338 days.

(21) Appl. No.: 14/216,097

(22) Filed: Mar. 17, 2014

(65) Prior Publication Data

US 2014/0276283 A1 Sep. 18, 2014

Related U.S. Application Data

(60) Provisional application No. 61/800,240, filed on Mar. 15, 2013.

(51) Int. Cl.
*A61H 9/00* (2006.01)

(52) U.S. Cl.
CPC ... *A61H 9/0078* (2013.01); *A61H 2201/0157* (2013.01); *A61H 2201/0184* (2013.01); *A61H 2201/164* (2013.01); *A61H 2201/165* (2013.01); *A61H 2201/1635* (2013.01); *A61H 2201/5002* (2013.01); *A61H 2201/5007* (2013.01); *A61H 2201/5071* (2013.01); *A61H 2209/00* (2013.01)

(58) Field of Classification Search
CPC ..... A61H 9/0078–9/0092; A61H 2201/0103; A61H 2201/165; A61H 2201/5058; A61H 2205/106; A61H 2209/00; F04D 27/004
USPC ..... 417/326, 12, 44.2
See application file for complete search history.

(56) References Cited

U.S. PATENT DOCUMENTS

| | | | | |
|---|---|---|---|---|
| 4,197,837 | A * | 4/1980 | Tringali | A61G 7/05776 137/565.27 |
| 5,626,556 | A | 5/1997 | Tobler et al. | |
| 5,634,889 | A * | 6/1997 | Gardner | A61H 9/0078 601/148 |
| 5,647,986 | A * | 7/1997 | Nawathe | C02F 3/006 210/195.3 |
| 5,715,548 | A * | 2/1998 | Weismiller | A61G 7/002 5/611 |
| 7,871,387 | B2 | 1/2011 | Tordella et al. | |
| 2005/0070828 | A1 | 3/2005 | Hampson | |

(Continued)

*Primary Examiner* — Rachel Young
(74) *Attorney, Agent, or Firm* — Schwegman, Lundberg & Woessner, P.A.

(57) ABSTRACT

A portable micro air pump includes a body, an air output port and a quick-disconnect air tube connector. The body is hand-sized, and has a user control and information panel with a power on/off button switch and a button switch for choosing which type of therapy garment is to be utilized, limb or foot. Status lights within the information panel show on/off and battery status, the therapy garment selected and alarm states of which the user needs to be aware. Within the body are an air compressor with an air output tube, a battery power source, and an electronic circuit board. The electronic circuit board has functional subunits including: a controller, a timer, a memory, an input/output interface, a pressure sensor, a status light driver and a power control driver.

19 Claims, 10 Drawing Sheets

(56) References Cited

U.S. PATENT DOCUMENTS

| | | | | |
|---|---|---|---|---|
| 2005/0075531 | A1* | 4/2005 | Loeb | A61H 9/0078 600/17 |
| 2008/0245361 | A1 | 10/2008 | Brown | |
| 2008/0249441 | A1 | 10/2008 | Avitable | |
| 2008/0249442 | A1 | 10/2008 | Brown | |
| 2008/0249443 | A1 | 10/2008 | Avitable | |
| 2008/0249444 | A1 | 10/2008 | Avitable | |
| 2008/0249447 | A1 | 10/2008 | Brown | |
| 2008/0249449 | A1 | 10/2008 | Brown | |
| 2008/0249455 | A1 | 10/2008 | Brown | |
| 2010/0268130 | A1* | 10/2010 | Khan | A61H 9/0078 601/46 |
| 2012/0089063 | A1* | 4/2012 | Olson | A61H 9/0078 601/152 |
| 2012/0209153 | A1* | 8/2012 | Farrow | A61H 9/0092 601/18 |
| 2012/0323152 | A1* | 12/2012 | Schubert | A61H 9/0092 601/149 |

* cited by examiner

PORTABLE MICRO AIR PUMP FOR USE IN INTERMITTENT PNEUMATIC COMPRESSION THERAPY

RELATED APPLICATION

This application claims the benefit of priority to U.S. Provisional Application No. 61/800,240, filed on Mar. 15, 2013, entitled "Portable Micro Air Pump for Use in Intermittent Pneumatic Compression Therapy", and currently co-pending.

FIELD OF THE INVENTION

The present invention relates generally to medical and therapy devices. The present invention is more particularly useful as an air pump for use with compression garments in the prevention of deep vein thrombosis. The present invention is particularly useful to prevent deep vein thrombosis during periods of low or no activity to continually circulate blood through a patient's extremities.

BACKGROUND OF THE INVENTION

Deep Vein Thrombosis, or "DVT", is a blood clot ("thrombus") that forms in a vein deep in the body. A thrombus occurs when blood thickens and clumps together. Most of these thrombi occur in the lower leg or thigh; however, they can also occur in other parts of the body. Thrombi located in the thigh are more likely to break off and cause a pulmonary embolism ("PE") than clots in the lower leg or other parts of the body. The clots that form close to the skin usually cannot break off and cause a PE due to their reduced size and the reduced pressures exerted on them.

A DVT, or a portion of it, can break off and travel through the bloodstream where it can enter the lung and block blood flow. This condition is called pulmonary embolism, which is considered to be very serious due to its likelihood of causing damage to the lungs and other organs and can quite possibly lead to death. This condition affects more than 2.5 million Americans each year and is associated with an estimated 50,000 to 200,000 deaths annually.

The venous system is designed to allow for the return of blood to the right side of the heart. Veins are not passive tubes through which blood passes, but are a system that uses muscular compressions, gravity, and inter-venous valves to promote and control the flow of blood through them. The valves are located along the entire length of the vein and ensure that blood only flows in one (1) direction, toward the heart. Blood flow may easily pass through the valve in the direction toward the heart but when pressure is greater above the valve than below, the cusps will come together, thereby closing the valve and stopping the flow of blood away from the heart.

The valves consist of two very thin-walled cusps that originate at opposite sides of the vein wall and come together to meet at the midline of the vein. The diameter of the vein is slightly larger just behind a valve where the cusps attach to the vein wall. Due to the larger diameter of the vein and the propensity for blood to collect and stagnate between the valve cusps and the vein wall, thrombi formation in this area is more likely.

The most common causes of DVT are venous stasis, blood vessel wall injury, and hypercoagulability. Venous stasis is the reduction of blood flow, most notably in the areas of venous valves, usually caused by extended periods of inactivity. These periods of inactivity minimize the muscular compressions applied to the veins therefore removing the forces used to propel the blood through the veins. This reduction in flow allows the blood to collect and congeal thereby forming a clot. The conditions that contribute to venous stasis include heart disease, obesity, dehydration, pregnancy, a debilitated or bed-ridden state, stroke, and surgery. Stasis has been known to develop with surgical procedures lasting as little as thirty (30) minutes.

Vessel wall injury can disrupt the lining of the vein thereby removing the natural protections against clotting. The loss of natural protection will increase the chances of clot formation and the subsequent mobilization of the clot that can lead to a PE. Some of the major causes of vessel wall injury are trauma from fractures and burns, infection, punctures of the vein, injection of irritant solutions, susceptibility to DVT, and major surgeries.

Hypercoagulability exists when coagulation outpaces fibrinolysis, which is the body's natural mechanism to inhibit clot formation. When this condition exists, the chances of clot formation, especially in areas of low blood flow, are greatly increased. Some causes of hypercoagulability are trauma, surgery, malignancy, and systemic infection. A typical treatment is the administration of an anticoagulant such as of low-molecular-weight heparin.

It is recognized that clots usually develop first in the calf veins and "grow" in the direction of flow in the vein. The clots usually form behind valve pockets where blood flow is lowest. Once a clot forms, it either enlarges until it is enveloped, which causes the coagulation process to stop, or the clot may develop a "tail" which has a high chance of breaking off and becoming mobile where it can enter the pulmonary system and become lodged in the lungs.

In a patient with DVT, the goals are to minimize the risk of a PE, limit further clots, and facilitate the resolution of existing clots. If a potential clot is suspected or detected, bed rest is usually recommended to allow for the clot to stabilize and adhere to the vein wall thereby minimizing the chance of the clot becoming mobile where it can travel to the lungs. A more effective preventative measure is ambulation, which is to walk about or move from place to place. Ambulation requires muscle movement. The muscle movement will provide a continuous series of compressions to the veins thereby facilitating the flow of blood. The continuous flow of blood will reduce or eliminate any areas of stasis so clots do not have a chance to form. For people who are confined to a bed or will be immobile for an extended period of time, leg elevation is recommended. This will promote blood return to the heart and will decrease any existing venous congestion.

Graduated compression stockings have also been used to apply pressure to the veins so as to reduce or minimize any areas of low flow in the vein, while not allowing the collection and coagulation of blood in these low flow areas. The stockings are designed to provide the highest level of compression to the ankle and calf area, with gradually decreasing pressure continuing up the leg. The stockings prevent DVT by augmenting the velocity of venous return from the legs, thereby reducing venous stasis. Typically, stockings are applied before surgery and are worn until the patient is fully able to move on their own. The stockings need to fit properly and be applied correctly. If too tight, they may exert a tourniquet effect, thereby promoting venous stasis, the very problem they intend to prevent. If too loose, the stocking will not provide adequate compression.

Another treatment of DVT involves the use of intermittent pneumatic compression (IPC). IPC can be of benefit to patients deemed to be at risk of deep vein thrombosis during extended periods of inactivity and is an accepted treatment method for preventing blood clots or complications of venous stasis in persons after physical trauma, orthopedic surgery, neurosurgery, or in disabled persons who are unable to walk or mobilize effectively.

An IPC uses an air pump to inflate and deflate airtight sleeves, or garments, wrapped around the leg. The successive inflation and deflations simulate the series of compressions applied to the veins from muscle contractions, thereby limiting any stasis that can lead to thrombi formation. This technique is also used to stop blood clots from developing during surgeries that will last for an extended period of time.

In order to deliver proper and safe medical therapy to the patient, the air pump used in IPC systems must have necessary qualities, characteristics, durability and overall performance capabilities. The pump must reliably create a user-specified pressure in the compression sleeve on the patient, and maintain it within a narrow range for a specified time period with minimal variability, in time or pressure, through countless repetitions of inflation and deflation. To avoid issues of medical concern, such as tissue hypoxia or structural damage, the pump must be able to sense over-inflation of the garment beyond the set pressure, and decrease pressure through slight deflation or by signaling the user to make appropriate changes.

Additionally, the portability of an IPC system is important, and is limited by the air pump, typically due to AC power requirements and/or physical size. In hospitals, care facilities, and home therapy settings the patient typically needs to be moved or transferred between rooms or buildings. Such situations can present a significant period of time during which no compression therapy is occurring, creating an increased risk of clotting, DVT, and possible resultant PE.

Another version of IPC is the Venous Foot Pump which provides an alternative to the traditional thigh or calf compression device. The foot pump mimics the natural effects of walking and weight-bearing on the circulation in the feet and legs through compressions applied to the foot. PE remains the most common preventable cause of death in hospitalized patients. The deaths are most often a complication resulting from the formation of a DVT and the subsequent PE that may result from it.

In light of the above, it would be advantageous to provide a deep vein thrombosis prevention system with an air pump that minimizes the occurrence of deep vein thrombosis formation. It would be further advantageous to provide a deep vein thrombosis prevention system having an air pump that allows medical personnel to customize the compression of limbs being treated to optimize treatments for particular patients. It would be further advantageous to provide a deep vein thrombosis prevention system having an air pump that is compact and portable. It would be further advantageous to provide a deep vein thrombosis prevention system having an air pump that is easy to use, relatively easy to manufacture, and comparatively cost efficient.

SUMMARY OF THE INVENTION

The portable micro air pump for use in Intermittent Pneumatic Therapy (hereafter known as "micro air pump") of the present invention includes an air supply output port and a body having a top and bottom portion, which create a hollow interior. Within the top of the body is a control and information panel with user-operated buttons and status lights. Within the hollow interior of the body is an air supply connected to an air pressure sensor via an air tube, a battery power supply, and an electronic circuit board controlling the micro air pump's function. The air supply output port, an extension of the air tube within the body, supplies air to an Intermittent Pneumatic Compression ("IPC") Therapy device garment through a flexible air supply tube. The micro air pump device is sized to be comfortably held in one hand.

The micro air pump of the present invention is controlled through buttons on top of the device, which include a power on/off switch and a garment selection switch. Powering on the pump by pressing the power button illuminates a power status light. Pressing the button again turns the pump and the light off. The garment selection button allows a user to select which type of IPC therapy garment is being used, limb or foot. Therapeutic parameters, such as air pressure, vary depending upon whether a foot or a limb (calf, thigh, or arm) is being treated. For example, an air pressure of 40 mmHg may be used when treating a patient's calf while 80 mmHg may be necessary for foot compression therapy. One (1) of two (2) lights illuminates to indicate which garment type, limb or foot, is currently active.

Status and alarm indicators are also located in the top portion of the micro air pump body. A battery status light indicates sufficient or insufficient charge remaining. An alarm light illuminates to signal the user if there is a state of continuous, non-cycling pressure (solid light) or over pressure (blinking light) occurring in the IPC garment. A second alarm light blinks or remains solid to show a state of high or low pressure in the garment, respectively. An input/output port found inside the body of the micro air pump allows for connection to a computer for calibration and program mode adjustments.

In use, the IPC therapy garment is worn by a patient on an extremity that is subject to development of thrombosis, particularly deep vein thrombosis, and particularly during surgery or extended periods of inactivity. The deep vein thrombosis prevention garment is wrapped snugly about a patient's leg, for example. The air supply tube is connected to an input port on the garment and to the air supply output port of the micro air pump of the present invention via industry-standard air tube connectors. The user then presses the power button, and selects the garment type being used by using the garment selection button. Once activated, the micro air pump provides a periodic air supply to the garment through the flexible air supply tube leading to an air chamber in the garment.

The air pressure is maintained through the flexible air supply tube, the air filled chamber becomes pressurized to a predetermined pressure, such as 40 mmHg. As the air-filled chamber inflates, it provides additional pressure on the leg of the patient to urge blood flow further upward through the leg.

The inflation of the air-filled chamber, coupled with the valves within the venous structure of the limb, creates a peristaltic force on the veins within the limb being treated. Once the air-filled chamber is pressurized to a predetermined pressure, the pressurized air supplied by the micro air pump of the present invention to the flexible air supply tube is discontinued, and the air filled chamber deflates, returning the deep vein thrombosis prevention garment to its fully un-inflated configuration. In this fully un-inflated configuration, blood flows freely through the limb being treated.

The inflation and deflation timing cycle of the micro air pump of the present invention is determined by the pressures being utilized, and the speed by which the air chamber of the deep vein thrombosis prevention garment deflates. In order to effectively urge blood flow through deep veins, the timing for the peristaltic effect of the micro air pump and the garment is approximately twenty (20) seconds per cycle.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF A PREFERRED EMBODIMENT

Figure 1:
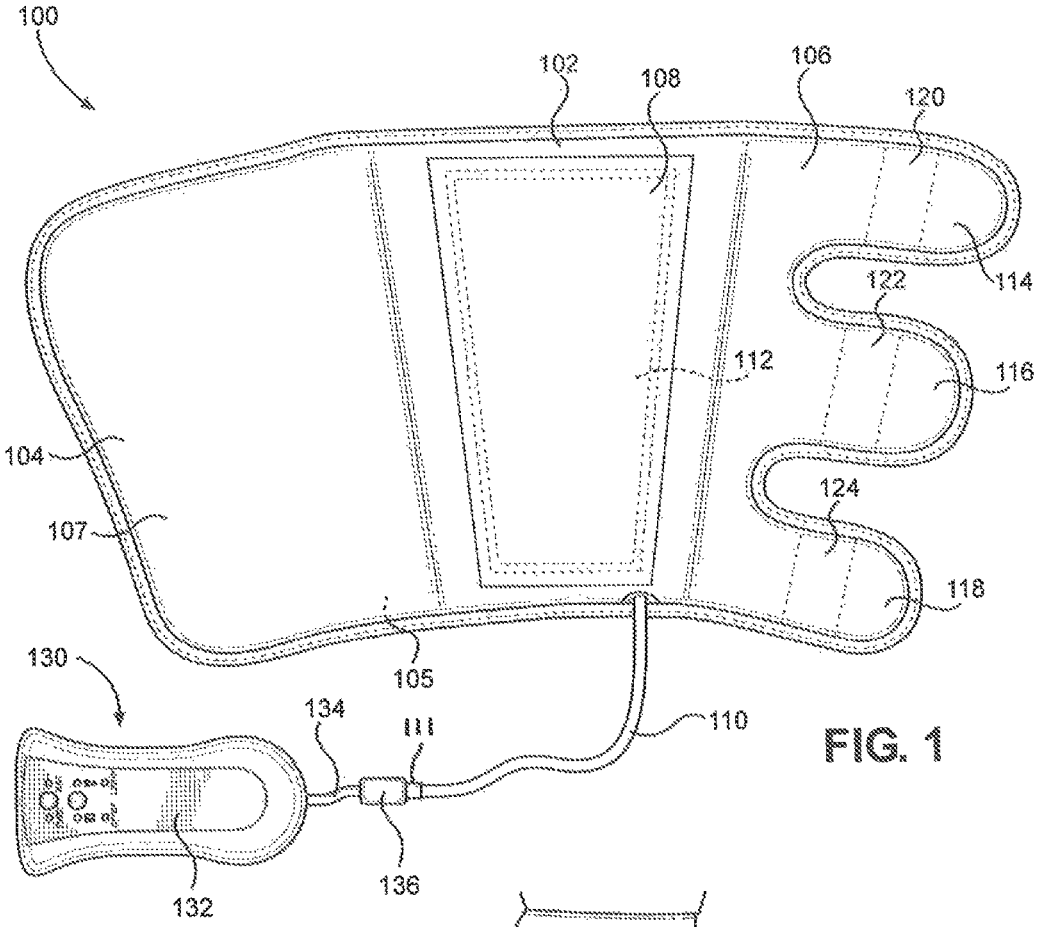
FIG. 1 is a top plan view of the micro air pump of the present invention showing a body with a control and information panel and an air output tube with a connector connected to an air chamber (shown in dashed lines) within a deep vein thrombosis prevention garment via a flexible air supply tube.

Referring initially to FIG. 1, a top plan view of the micro air pump of the present invention is shown and generally designated 130. Micro air pump 130 includes a body 132, an air output port 134, and an industry-standard quick-disconnect connector 136 known in the industry to facilitate the use of different devices with the air pump 130. In a preferred embodiment, the micro air pump 130 of the present invention supplies air to a deep vein thrombosis prevention garment generally designated 100, through a flexible air supply tube 110. Garment 100 is representative of a typical garment used in the therapeutic treatment of deep vein thrombosis on a limb of a patient. Garment 100 is made of a flexible material having an inner side 105 (shown in dashed lines) and an outer side 107, and includes a central panel 102, a right side panel 106 and a left side panel 104.

Flexible air supply tube 110 enters central panel 102 and leads to a single air chamber 112 (shown in dashed line) located between central panel 102 and a flexible cover 108. The flexible air supply tube 110 is shown having a non-descript length. It is to be appreciated that the length of the air supply tube 110 may vary depending on the particular field of use, and the setting.

Air supply tube 110 is connected to the quick-disconnect connector 136 of micro air pump 130 via a mating quick-disconnect connector 111 on air supply tube 110. Air is supplied to flexible air supply tube 110 from micro air pump 130 of the present invention. Micro air pump 130 includes a compressor capable of providing a predetermined maximum air pressure that provides a pressure force to fill the air chamber 112. As will be described in greater detail below, micro air pump 130 can provide air at a predetermined pressure for a predetermined period of time, providing for an inflation and deflation cycle according to the desired therapy parameters.

As shown in FIG. 1, right side panel 106 of the deep vein thrombosis prevention garment 100 is formed with a number of attachment straps 114, 116, and 118, with each strap having an integral fastener 120, 122, and 124, respectively. In common designs within the industry, straps 114, 116, and 118 are provided with the hook portion of a hook-and-loop style fastener 120, 122, and 124. This hook portion of the hook-and-loop fastener cooperates with the outer side 107 of left side panel 104, to allow the deep vein thrombosis prevention garment 100 to be positioned about a patient's limb and secured in place by wrapping the panels 102, 104 and 106 around the limb and pressing the fasteners 120, 122, and 124 on straps 114, 116, and 118 firmly against the outer side 107 of panel 104. The hook-and-loop fasteners are attached to the outer side 107 of panel 104 to hold the straps 114, 116, and 118 in place.

While the micro air pump 130 of the present invention in a preferred embodiment is connected to a deep vein thrombosis prevention garment for use on the limb of a patient, it is to be appreciated that, as will be shown in detail later, the micro air pump 130 is also configured for use on the foot of a patient with corresponding foot-specific garments.

Figure 2:
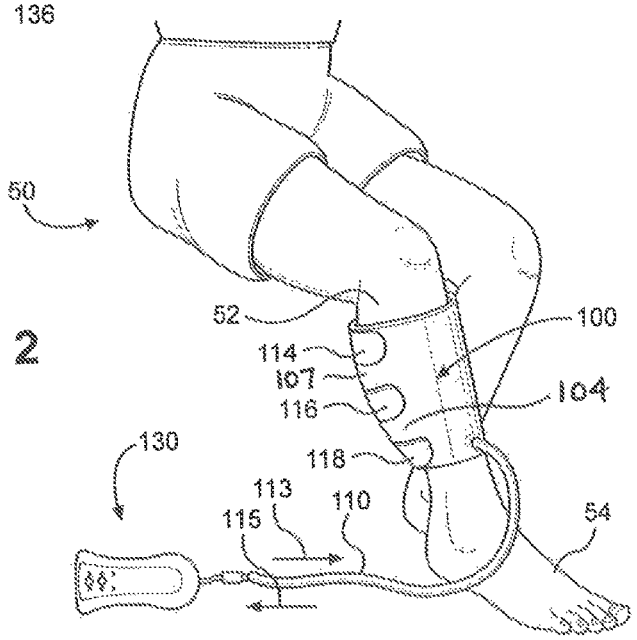
FIG. 2 is a view of the micro air pump of the present invention being used by a patient for the prevention of deep vein thrombosis, showing the micro air pump of the present invention supplying pressurized air through a flexible air supply tube to a deep vein thrombosis prevention garment wrapped around the patient's calf.

Referring now to FIG. 2, the micro air pump 100 of the present invention is shown being used by a patient 50 for the prevention of deep vein thrombosis. Specifically, as shown in FIG. 2, the deep vein thrombosis prevention garment 100 is positioned around the lower leg 52, or calf, of patient 50 and is in communication with micro air pump 130 of the present invention through flexible air supply tube 110. Deep vein thrombosis prevention garment 100 is positioned around the calf 52 of patient 50 by positioning panels 102 and 104 against the patient's leg, and then wrapping straps 114, 116, and 118 of panel 106 around the calf 52 and securing the straps to the outer side 107 of panel 104 with fasteners 120, 122, and 124. Micro air pump 130 supplies pressurized air through flexible air supply tube 110 to pressurize the air chamber 112 (shown in FIG. 1) within the deep vein thrombosis prevention garment 100 during periods of inflation and in reverse direction during deflation, shown by directional arrows 113 and 115, respectively. This cyclic pressure of an inflation-deflation cycle, in combination with the inter-venous valves present in the circulatory system, provides a peristaltic force on blood within the limb. The peristaltic force creates the near continual movement of blood within the limb being treated, thereby avoiding the formation of deep vein thrombosis.

FIG. 2 depicts a patient in a sitting position undergoing deep vein thrombosis prevention treatment on one (1) leg. However, this is merely exemplary of the typical use of the micro air pump 130 of the present invention. Indeed, the micro air pump 130 of the present invention may be used with the patient 50 virtually in any position. The portability of micro air pump 130 even allows treatment of a patient who is ambulatory so as to prevent interruption of deep vein thrombosis prevention treatment while the patient goes to the lavatory, for example. Micro air pump 130 may also be used, as mentioned, on the foot 54 of patient 50 with a foot-specific garment (not shown).

It is also to be appreciated that while FIG. 2 depicts a patient 50 having only one (1) deep vein thrombosis prevention garment on a leg, a number of deep vein thrombosis prevention garments may be used simultaneously, each inflated and deflated by a separate micro air pump 130 of the present invention. For instance, in a surgery setting, it is commonplace to utilize the deep vein thrombosis prevention garments of the present invention on both legs.

Figure 3:
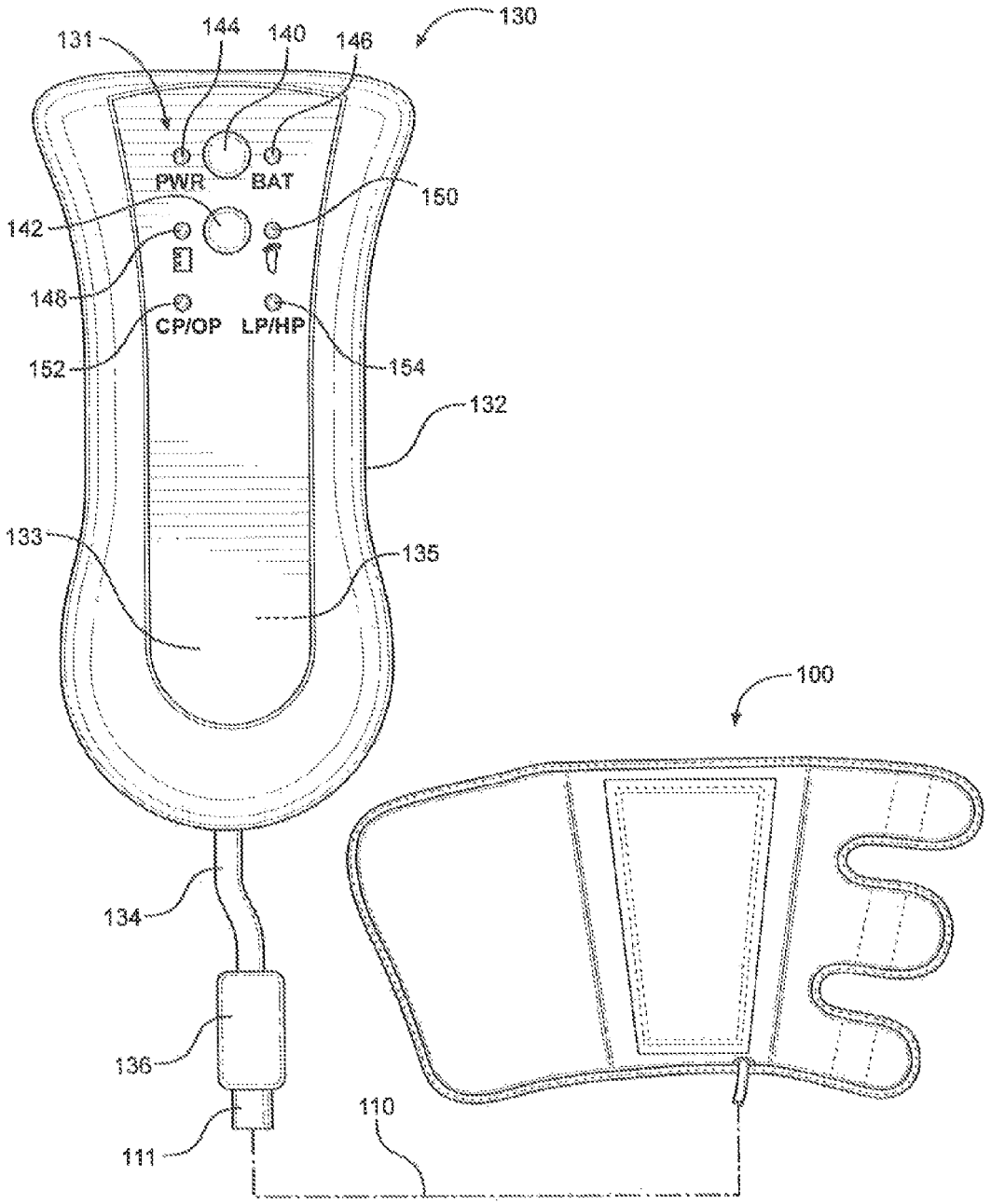
FIG. 3 is a magnified top plan view of the control and information panel of the body of the micro air pump of the present invention with the micro air pump connected to the deep vein thrombosis prevention garment via the flexible air supply tube (shown with a dashed line)

Referring now to FIG. 3, a magnified top plan view of the micro air pump 130 of the present invention is shown connected to deep vein thrombosis prevention garment 100 by air supply tube 110 (shown by dashed line) for reference. A user control and information panel, generally designated 131, is located within body 132 of the micro air pump 130.

Body 132 has a two-piece design having a top section 133 and a bottom section 135 (not visible and shown with dashed line). The top 133 and bottom 135 sections must be hard, durable, and impact resistant in addition to being inexpensive to manufacture. In a preferred embodiment, top 133 and bottom 135 sections of body 132 are made of a thermoplastic such as polyvinyl chloride (PVC) or acrylonitrile butadiene styrene (ABS). Both PVC and ABS are tough, impact resistant and relatively inexpensive to manufacture. In a preferred embodiment top section 133 connects to bottom section 135 of body 132 by small screws (not shown). It is to be appreciated that a snap-lock mechanism or any other method known in the art may be used to connect the top 133 and bottom 135 sections of body 132.

User control and information panel 131 is shown within top section 133 of body 132. A button on/off switch 140 turns the micro air pump 130 of the present invention on and off. When the micro pump 130 is powered on by depressing switch 140, a power status light 144 illuminates to alert the user the device is in operation. A battery status light 146 illuminates if insufficient battery capacity remains to properly run the micro air pump 130. The user then presses a garment type selection switch 142 to select the appropriate pressure and timing program for the deep vein thrombosis prevention garment connected to the micro air pump 130. Garment type selection switch 142 toggles between programs for a limb or foot garment, and displays the current selection by illumination of a limb status light 148 or a foot status light 150, respectively. This garment type selection option expands the therapeutic utility of the micro air pump 130 of the present invention as therapeutic pressures and timing of inflation or deflation may vary between the two (2) body regions.

Within the user control and information panel 131 shown in FIG. 3, two (2) alarm status indicators, a Constant Pressure/Over Pressure (CP/OP) alarm light 152 and a Low Pressure/High Pressure (LP/HP) alarm light 154, are shown. These lights communicate to the user improper function of the micro air pump 130, air supply tube 110, and the deep vein thrombosis prevention garment 100 system. When a constant air pressure is detected within the system, the CP/OP alarm light 152 will illuminate as a solid light. The CP/OP alarm light 152 will blink if there is a detection of over-pressure in the system. Constant, non-cycling air pressure may occur if there is a failure in deflation of the deep vein thrombosis prevention garment 100, thus creating a possible situation of medical concern, as blood stasis and subsequent clotting within the body part being treated can result. Over-pressure of the deep vein thrombosis prevention garment 100 results when the air pressure within the system exceeds the preset therapeutic level by a predetermined amount. Excessive air pressure can cause tissue damage in the patient 52. Some possible causes of over-pressure may be failure of air pressure regulation by micro air pump 130 or external compression of the deep vein thrombosis prevention garment 100 by the patient 50.

The Low Pressure/High Pressure (LP/HP) alarm light 154 illuminates as solid or blinking when a low or high air pressure is detected within the system, respectively. Low air pressure can occur for many reasons, such as low battery power, air pump 130 failure, a leaking or improperly connected air supply tube 110, or a leaking compression garment 100 on the patient 52. High air pressure may often be a sign of a kinked air supply tube 110.

It is to be appreciated that the alarm limits for illuminating the alarm lights, CP/OP 152 and LP/HP 154, will vary depending upon which garment type is chosen, as the therapeutic pressures and thus the limits differ between limb and foot treatment options.

Figure 4:
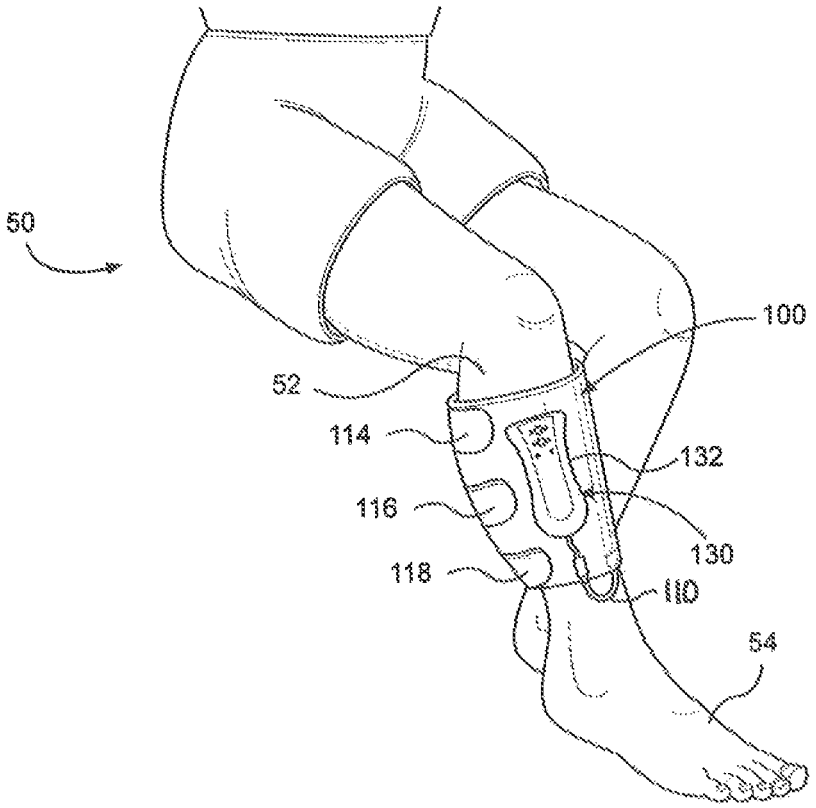
FIG. 4 is a view of the micro air pump of the present invention being used by a patient for the prevention of deep vein thrombosis, and demonstrating the size and portability of the micro air pump of the present invention attached to a deep vein thrombosis prevention garment wrapped around the patient's calf.

Referring now to FIG. 4, the portability and compactness of the micro air pump 130 of the present invention is exemplified through use by a patient 50 for the prevention of deep vein thrombosis. Specifically, as shown, the deep vein thrombosis prevention garment 100 is positioned around the lower leg 52, or calf, of patient 50 and is in communication with micro air pump 130 of the present invention through flexible air supply tube 110.

For convenience, micro air pump 130 is attached to the exterior of the deep vein thrombosis prevention garment 100 allowing patient 50 to easily ambulate without need for an additional bag, pouch or holster in which to carry the micro air pump 130. Micro air pump 130 may be attached to the deep vein thrombosis prevention garment 100 by many methods. In a preferred embodiment, micro air pump 130 is attached to the deep vein thrombosis prevention garment 100 through the use of the hook-portion of a hook-and-loop style fastener adhered to the body 132 of micro air pump 130 by adhesive backing. The hook portion of the fastener cooperates with the material of garment 100 to allow micro air pump 130 to mount directly on garment 100. Additionally, the loop-portion of the hook-and-loop style fastener may be affixed to the outside of the garment 100 in the event the material of garment 100 does not cooperate with the hook portion of the fastener. It is to be appreciated that micro air pump 130 of the present invention may be attached to deep vein thrombosis prevention garment 100 by any method known in the art.

Figure 5:
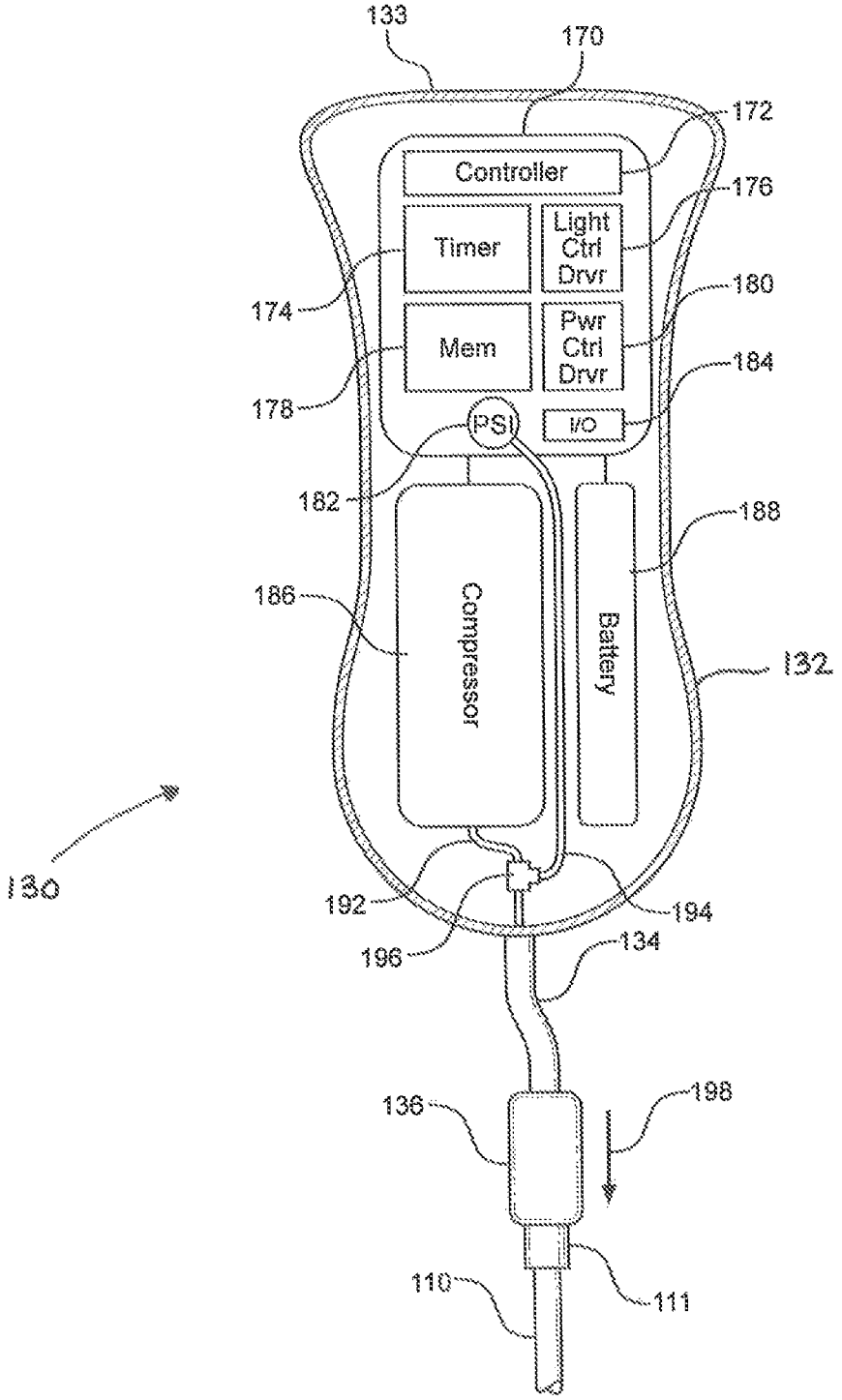
FIG. 5 is a close-up, bottom-perspective view of the interior of the micro air pump of the present invention with the bottom section of the body removed showing an air compressor, a battery power source, and an electronic circuit board with its various sections, and showing the air output port of the micro air pump connected to a flexible air supply tube.

FIG. 5 shows a view of the interior of the micro air pump 130 of the present invention from a bottom-up perspective with the bottom section 135 (shown in FIG. 3) of the body 132 removed. Within top section 133 of body 132 are shown the layout of the major components of micro air pump 130: an air compressor pump 186, a DC power source battery 188, and an electronic control circuit board 170. Control circuit board 170 has several functional subunits. A controller 172 regulates system air pressure and manages inflation/deflation timing of deep vein thrombosis prevention garment 100 (not shown) through a pressure sensor 182, a timer 174, a memory 178, and a power control driver 180. Controller 172 also coordinates illumination of LED status lights 144, 146, 148, 150, 152 and 154 (shown in FIG. 3) through status light driver 176 based upon user input selection using switches 140 and 142 (shown in FIG. 3) and an input/output (I/O) interface 184. Specific functional operation of the electronic control circuit board 170 will be detailed in FIG. 6.

Under control of circuit board 170, compressor 186 inflates the deep vein thrombosis prevention garment 100 in direction 198 by pumping air through an air tube 192 into air output port 134 and through air supply tube 110, which are connected to each other via quick-disconnect connectors 136 and 111, respectively. For air pressure control and monitoring, air is fed back through a sensor air tube 194 to pressure sensor 182 on circuit board 170 via an industry standard, air tube "T" connector 196. Deflation of garment 100 occurs in reverse of direction 198 with air moving through air supply tube 110, through air output port 134, air tube 192, and dissipates back through compressor 186 by normal system bleeding.

Figure 6:
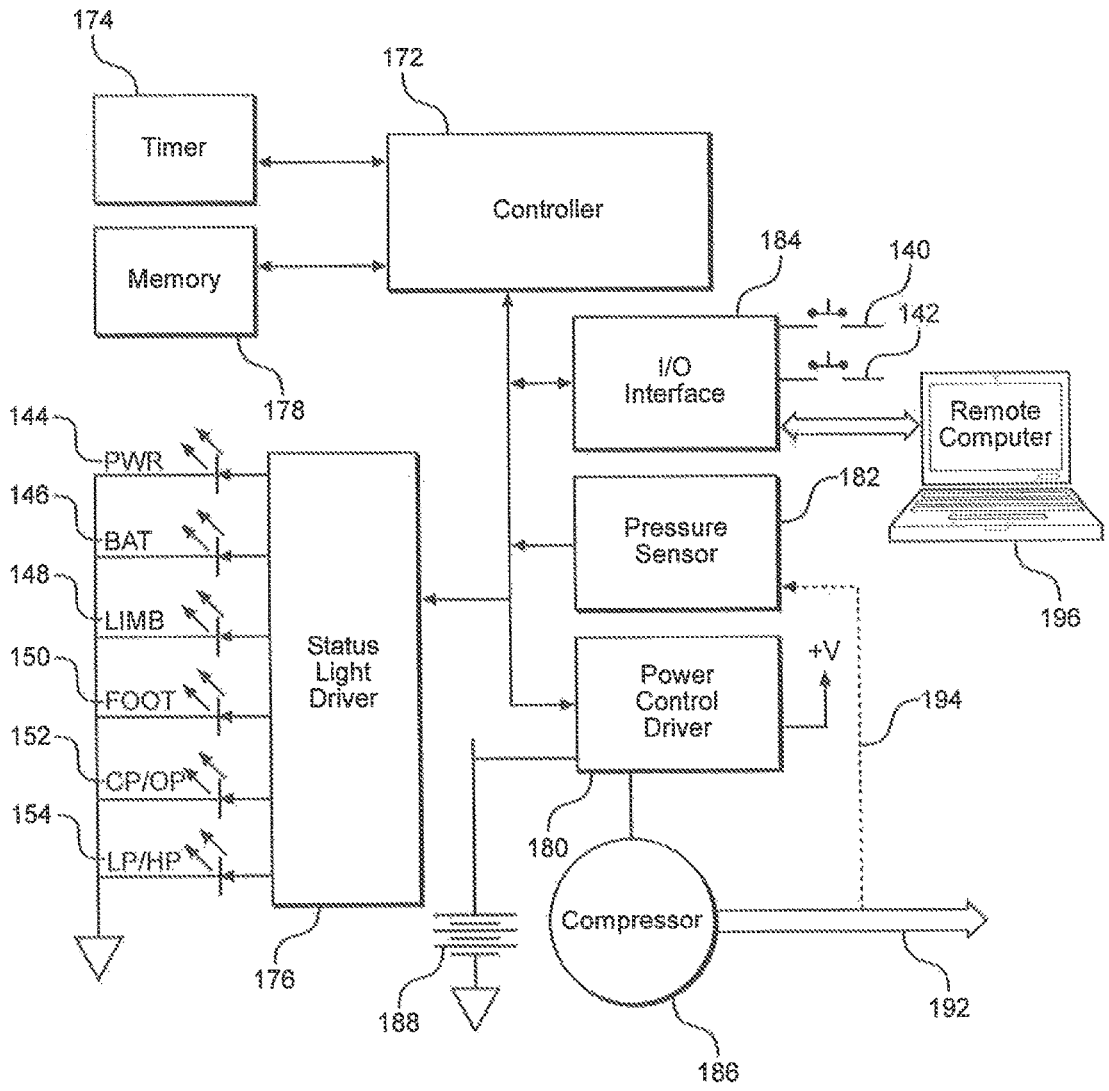
FIG. 6 is an exemplary operational diagram for the micro air pump of the present invention showing the interconnection and functional relationships between the components, mechanical and electrical.
Figure 7:
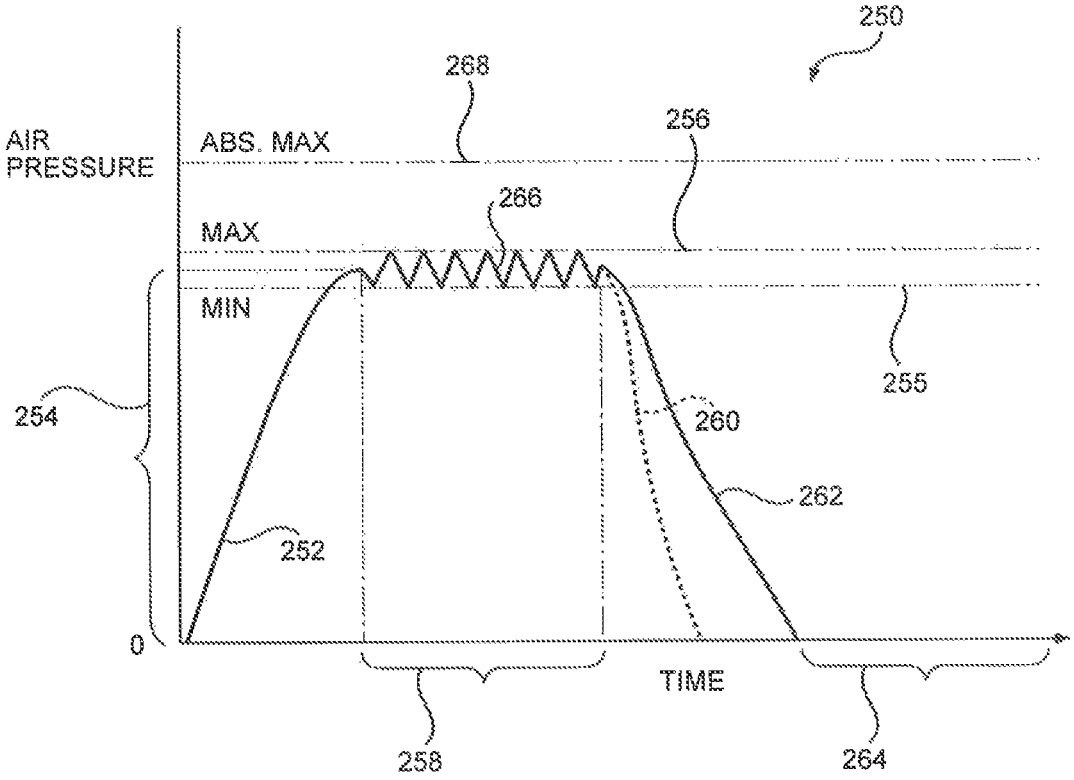
FIG. 7 is a graphical representation of the air pressure supplied from the micro air pump of the present invention to the deep vein thrombosis prevention garment, and showing a maximum air pressure to be delivered, and the sequential pressure within the air filled chamber during an inflation cycle before pressure supplied from the micro air pump is released and the air filled chamber deflates.

Referring now to FIG. 6, an exemplary operational diagram of the micro air pump 130 of the present invention is shown. As previously mentioned, controller 172 manages overall device operation in conjunction with timer 174 and memory 178. Memory 178 stores program information including maximum and minimum air pressure levels as well as timing presets for the two user-selected garment types, limb or foot, which may have differing treatment parameters. Timer 174 creates periodicity of inflation/deflation cycles, the duration of inflation and deflation, and the duration of time at which therapeutic air pressure is sustained. FIG. 7 will outline the timing cycles and differing limb/foot treatment parameters in detail.

In a preferred embodiment, controller 172 is a microprocessor with integrated memory and timing functions. Controller 172 receives input from user-operated power on/off switch 140 and garment type selection switch 142 through I/O interface 184, from a non-user accessible computer interface connection on I/O interface 184, and from pressure sensor 182. A remote computer 196 connecting through I/O interface 184 allows calibration of and changes to pressure and timing settings of the micro air pump 130 of the present invention through direct access to memory 178, providing device program customization. Memory 178 may also be configured through computer 196 to store real-time usage data such as air pressures and timing points of alarm triggers, like over pressure or continuous pressure for example.

In use, the user presses power button 140 placing the micro air pump 130 of the present invention in a powered-on state with illumination of power status light 144 through status light driver 176. If insufficient battery power is detected by controller 172, status light driver 176 is signaled to illuminate battery status light 146 to alert the user to replace DC power source battery 188 before beginning treatment. Next, garment type selection button 142 is pressed by the user to select whether a limb or foot is being treated. Garment type selection button 142 toggles between two (2) program modes stored in memory 178, which contains the specific timing and pressure parameter settings (detailed in FIG. 7). Controller 172 signals, through status light driver 176 and illumination of the appropriate garment type status light for limb 148 or foot 150, then accesses the appropriate timing and pressure parameters from memory 178. Cycle clocking in timer 174 is initiated followed by signaling of power control driver 180 to turn on air compressor 186. Air is pumped from compressor 186 through air tube 192 to the air output port 134 (not shown) of the micro air pump 130 of the present invention.

Feedback from air tube 192 through sensor air tube 194 to pressure sensor 182 allows controller 172 to compare current system pressure to the programmed therapeutic level stored in memory 178. Controller 172 essentially throttles air compressor 186 through power control driver 180 as needed to maintain programmed pressure settings. When an inflation cycle has ended, controller 172 reduces or cuts power to power control driver 180 slowing or stopping compressor 186, and air bleeds from the system in reverse direction through air tube 192, until timer 174 clocks the next inflation cycle to begin.

The four (4) alarm states are relayed to the user through status lights 152 and 154. If comparison of memory 178 programmed settings and pressure sensor 182 readings by controller 172 shows a constant, non-cycling pressure, status light driver 176 illuminates the CP/OP light 152 as solid and non-blinking. If comparison shows system pressure exceeds the programmed maximum allowed pressure, signifying a state of over-pressure, status light driver 176 illuminates CP/OP light 152 as blinking. In a similar comparative method, controller 172 signals illumination of LP/HP status light 154 as solid (LP) or blinking (HP) if air pressure in the system falls below a therapeutic minimum (low pressure) or rises above the therapeutic maximum (high pressure), respectively.

In a preferred embodiment, air compressor 186 is of a design known in the art and energy efficient. Pressure sensor 182 is of a design known in the art and can, in a preferred embodiment, be a strain gauge or other pressure-sensing device.

Referring now to FIG. 7, a graphical representation of the air pressure supplied from the micro air pump 130 of the present invention to the deep vein thrombosis prevention garment 100 is shown and generally designated 250. Graph 250 includes a vertical Air Pressure axis and a horizontal Time axis. This graph 250 depicts a typical inflation and deflation cycle that occurs from the micro air pump 130 of the present invention.

Graph 250 includes a primary supply air pressure curve 252 which corresponds to the air provided by micro air pump 130 to flexible air supply tube 110 (shown in FIGS. 1-5). This air supply begins at the start of the inflation cycle and rises to a preset, therapeutic air pressure 254. Preset therapeutic air pressure 254 is approximately equal to a maximum (MAX) and a minimum (MIN) desired therapeutic pressures 256 and 255, respectively (shown by dashed lines). A fluctuating air pressure curve 266 exemplifies how micro air pump 130 of the present invention maintains preset therapeutic air pressure 254 within this therapeutic range by increasing or decreasing compressor 186 (shown in FIG. 5-6) air output as needed.

An absolute air pressure (ABS MAX) is an overall maximum pressure 268 (shown by dashed line) that corresponds to an absolute maximum allowed pressure within air chamber 112 (shown in FIG. 1) of the deep vein thrombosis prevention garment 100, the maximum pressure medically safe, or any other maximum value utilized in the art to ensure safe operation of the micro air pump 130 of the present invention. ABS MAX 268 is the air pressure set point above which the micro air pump 130 of the present invention signals an alarm of over pressure.

In the micro air pump 130 of the present invention, the preferred maximum pressure for a deep vein thrombosis prevention garment is 40 mmHg for limb and 80 mmHg for foot treatment. It is to be appreciated, however, that different air pressures may be utilized for differing applications, treatment positions, duration of treatment, and other factors known and considered in the art.

The inflation cycle is completed once the air chamber 112 of deep vein thrombosis prevention garment 100 has had sufficient time to inflate. Following the inflation cycle, a delay 258 may be utilized to maintain a constant pressure on the limb 52 (shown in FIGS. 2 and 4) to provide time for the blood to flow through the limb. Following any delay, the deflation cycle begins and the pressure 260 in micro air pump 130 and air supply tube 110 decreases to zero.

As the decrease in pump and supply tube pressure 260 occurs, the pressure 262 in air chamber 112 likewise returns to zero in substantially the same time. Once this inflation and deflation cycle is completed, a delay 264 may be inserted prior to beginning the next inflation and deflation cycle.

In an embodiment, using the micro air pump 130 of the present invention, the time for a complete inflation cycle, deflation cycle and delay is approximately twenty seconds. As a result, the micro air pump 130 can be cycled three (3) times every minute in order to provide a continuous force to create the desired peristaltic effect. It is to be appreciated by those skilled in the art that the specific period for a complete cycle may be changed depending on the size of the limb or foot being treated, the pressure desired, and the peristaltic forces necessary to minimize the likelihood of the development of a thrombosis.

Alternative Embodiments

Figure 8:
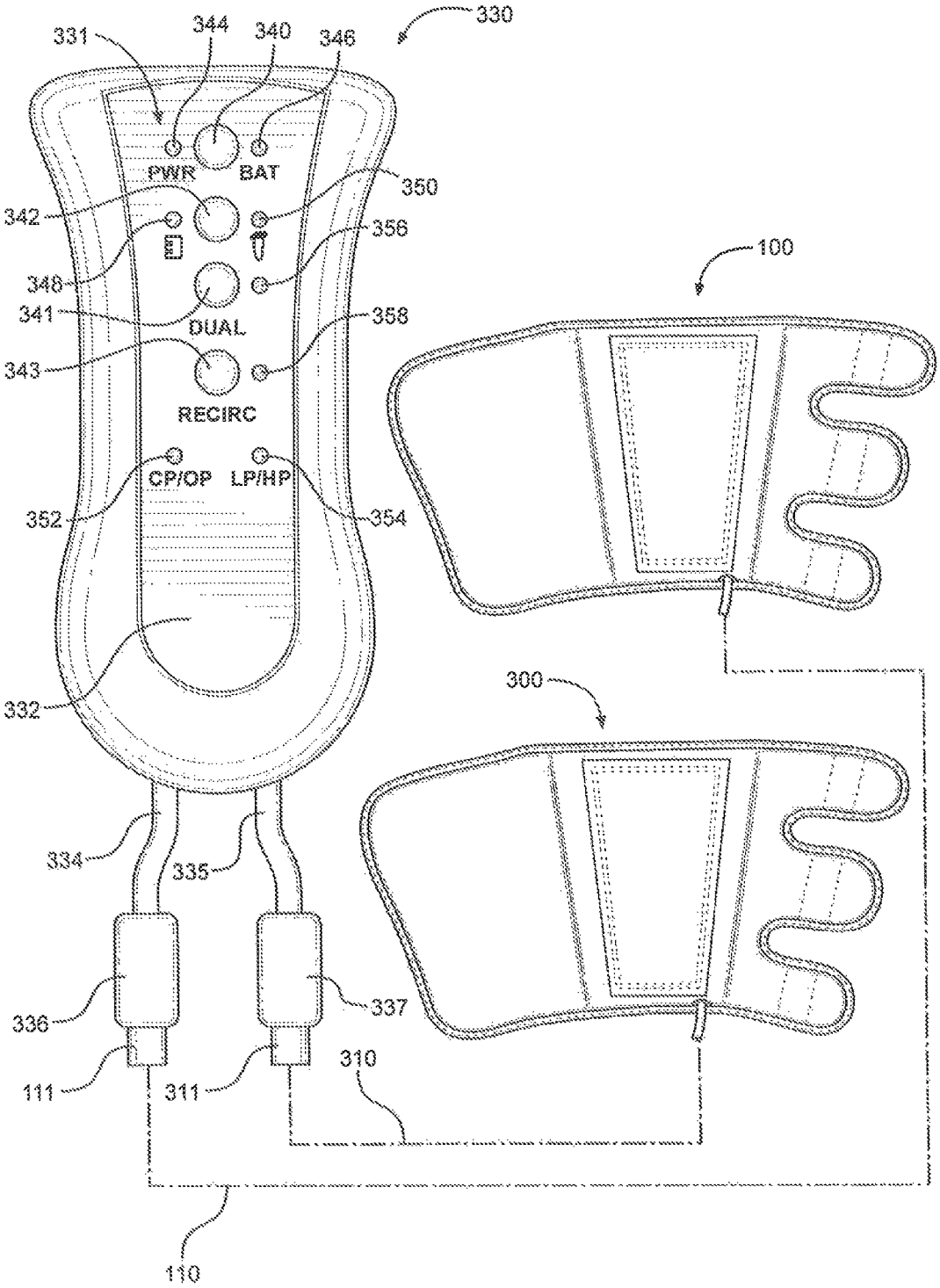
FIG. 8 is a magnified view of the alternative embodiment for the control and information panel of the body of the micro air pump of the present invention with the micro air pump connected to two (2) deep vein thrombosis prevention garment via flexible air supply tubes, when two (2) garments are simultaneously selected for by pressing a dual garment mode selector button on the control and information panel of the body.

Referring now to FIG. 8, an alternative embodiment of the micro air pump of the present invention is shown and generally designated 330. Otherwise identical to the above described preferred embodiment, alternative embodiment micro air pump 330 adds the capability of supplying air to two (2) deep vein thrombosis prevention garments 100 and 300, which are simultaneously selected by pressing a dual garment mode selector button (DUAL) 341. Illumination of a dual garment mode status light 356 signifies the micro air pump 300 is in dual pump mode.

In conjunction with the dual pump mode, micro air pump 300 of the present invention has an air recirculation feature turned on by an air recirculation (RECIRC) button 343, and designated as in operation when a recirculation mode status light 358 is illuminated. Other buttons (power 340 and garment type selection 342) and status lights (power 344, battery 346, garment type limb 348 or foot 350, continuous/over pressure 352, and low/high pressure 354) remain the same functionally as previously described.

Two (2) air output ports 334 and 335 with quick disconnect connectors 336 and 337, respectively, extend from body 332 of micro air pump 330 of the present invention. The two (2) air output ports 334 and 335 allow simultaneous connection of the micro air pump 330 to two (2) deep vein thrombosis prevention garments 100 and 300 via air supply tubes 110 and 310, respectively (shown as dashed lines for reference). Air supply tubes 110 and 310 couple to the quick-disconnect connectors 336 and 337 on air outputs 334 and 335 via mating connectors 111 and 311, respectively. While the deep vein thrombosis prevention garments 100 and 300 for treatment of limbs have been portrayed, it is to be appreciated that foot-specific treatment garments may also be connected.

Figure 9:
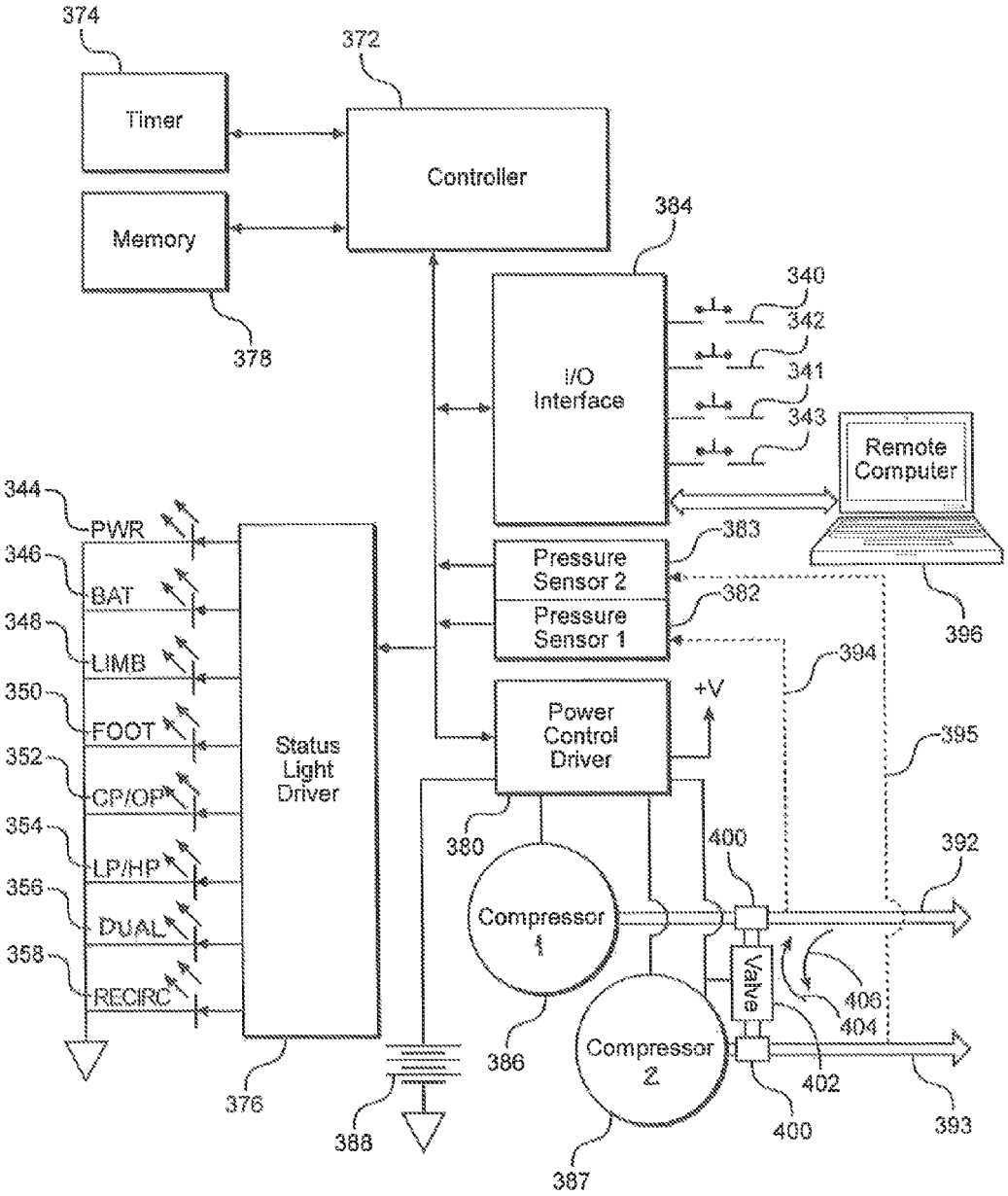
FIG. 9 is an exemplary operational diagram for the alternative embodiment of the micro air pump of the present invention showing the interconnection and functional relationships between the mechanical and electrical components.

FIG. 9 is an exemplary operational diagram of the micro air pump 130 of the present invention showing the addition of dual garment mode selector switch (DUAL) 341 and air recirculation switch (RECIRC) 343 to the Input/Output interface 384 along with the addition of corresponding LED status lights, DUAL 356 and RECIRC 358 to the output of status light driver 376. Power control driver 380 drives two (2) compressors: air compressor-1 386 and air compressor-2 387. Air compressor-1 386 and air compressor-2 387 output air through air tubes 392 and 393, connecting to air output ports 334 and 335 (shown in FIG. 8), respectively. Air tubes 392 and 393 are in communication with each other through an electromechanical recirculation valve 402 connected to air tubes 392 and 393 by industry-standard tube "T" connectors 400. Valve 402 is controlled by power control driver 380. Both air tubes 392 and 393 feed air back to pressure sensors 382 and 383 via air tubes 394 and 395, respectively.

In use, after powering the circuit on with power switch 340 and selection of garment type (limb or foot) with switch 342, accompanied by the lighting of corresponding power 344 and limb 348 or foot 350 status lights, the dual garment mode selector switch 341 is used to select whether one (1) or two (2) deep vein thrombosis prevention garments are being used by the patient.

When in single garment mode, there is no illumination of DUAL status light 358 by status light driver 376. Through power control driver 380, controller 372 closes valve 402 to maintain two discrete air compressor-air tube systems. Controller 372 then retrieves timing and pressure information from memory 378 for whichever garment type, limb or foot, was selected for by switch 342, and initiates activation of only air compressor-1 386 through power control driver 380. The micro air pump 330 of the present invention functions as a single air compressor pump as previously described. RECIRC switch 343 is inactivated when the system is in single garment mode.

When dual garment mode is selected by pressing selector switch 341, controller 372 activates function of RECIRC switch 343, and signals illumination of the DUAL garment status light 356 through status light driver 376. With RECIRC switch 343 off, corresponding RECIRC status light 358 is unlit, and controller 372 activates function of a dual, independent air compressor-garment program. In addition, status light driver 376 is signaled to illuminate battery status light 346 to alert the user to replace DC power source battery 388 before beginning treatment.

Figure 10:
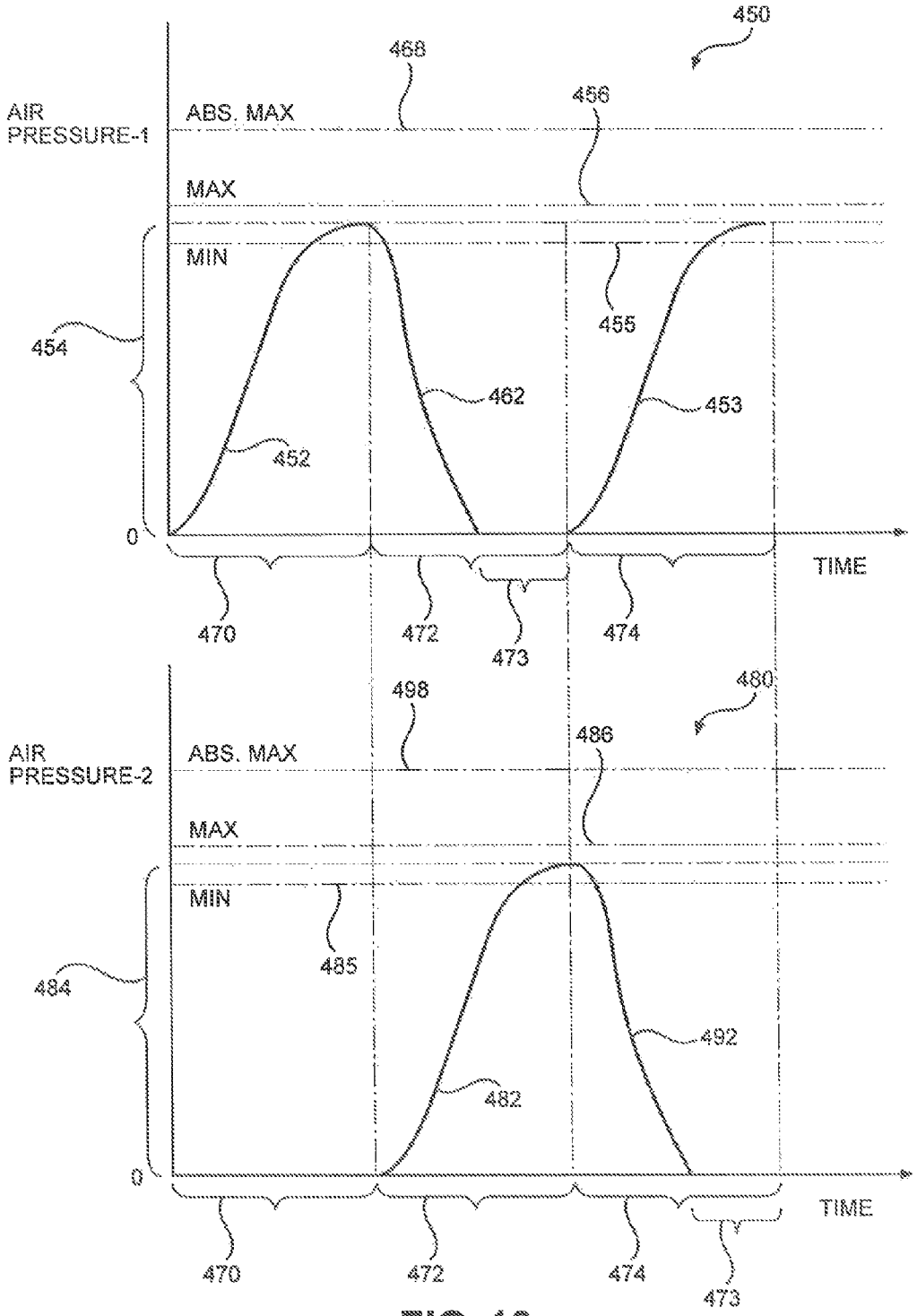
FIG. 10 is graphical representations of the air pressure supplied from the alternative embodiment of the micro air pump of the present invention to two (2) deep vein thrombosis prevention garments, and showing their maximum air pressures to be delivered, and the sequential pressures within the air filled chamber of each garment, during the inflation cycles before the pressures supplied from the micro air pump are released and each of the air filled chambers deflate.

In this configuration, power control driver 380 keeps recirculation valve 402 closed, so air compressor-1 386 and air compressor-2 387 and their corresponding air tube outputs 392 and 393, respectively, run discretely. Controller 372 accesses programmed timing and pressure settings from memory 378 based upon the garment (limb or foot) specified by garment type selector switch 342. Timer 374 then initiates inflation/deflation cycling. Compressor-1 386 is powered first by power control driver 380, and outputs air through air tube 392 ending at the deep vein thrombosis prevention garment 100 (not shown). Once the garment 100 has reached maximum therapeutic pressure, power control driver 380 powers down compressor-1 386 for the deflation portion of the cycle, and powers on compressor-2 387 to begin the inflation portion of its cycle. When the deep vein thrombosis prevention garment 300 (not shown) has reached its maximum therapeutic pressure, as detected by pressure sensor 383, compressor-2 387 is powered down by power control driver 380 entering a deflation cycle, and compressor- 1 386 is then powered back on to begin another inflation sequence. FIG. 10 details this graphically. This alternating inflation/deflation cycling between the compressor-1 386 and compressor-2 387 systems proceeds until the power switch 340 is turned off.

Now, if RECIRC switch 343 is turned on, the corresponding RECIRC status light 358 is lit and controller 372 activates function of a dual, interconnected air compressor-garment program utilizing recirculation valve 402. In this recirculation mode, high pressure air from one compressor-air tube system, which is beginning deflation, is "recycled" through valve 402, exemplified by arrows 404 and 406, and into the other compressor-air tube system to assist it in achieving a quicker inflation time with decreased power consumption.

When controller 372 initiates an inflation sequence of garment 100 (not shown) by powering on compressor-1 386 through power driver 380, recirculation valve 402 is closed. At the time when the maximum therapeutic air pressure in garment 100 is achieved, as determined by pressure sensor 382, controller 372 initiates deflation of garment 100 by powering down compressor-1 386. Normally, deflation would occur through system bleeding as air passed from garment 100 (not shown) through air supply tube 110 (not shown), air output port 334 (not shown), into air tube 392 and out compressor-1 386. With RECIRC switch 343 turned on, upon initiation of deflation of garment 100 and inflation of garment 300 (not shown), controller 372 powers on compressor-2 387 and opens recirculation valve 402 to allow the pressurized air from air tube 392 to flow into air tube 393 in direction 406. This continues until controller 382 detects similar pressures in feedback air tubes 394 and 395 via pressure sensors 382 and 383, at which time recirculation valve 402 is closed, and deflation continues in the compressor-1 386 system and inflation proceeds in the compressor-2 387 system. The recirculation valve 402 opens again upon subsequent deflation of the compressor-2 387 system and repeat inflation of the compressor-1 386 system with air passing from tube 393 to tube 392 through valve 402 in direction 404.

It is to be appreciated that many timing settings for opening and closing the recirculation valve 402 may be known to those skilled in the art, and changes or modifications of this embodiment of the present invention can be made without departing therefrom.

Referring now to FIG. 10, graphical representations of the air pressure supplied from the micro air pump 330 (shown in FIG. 8) of the present invention to deep vein thrombosis prevention garments 100 and 300 are shown and generally designated 450 and 480, respectively. Graphs 450 and 480 include a vertical Air Pressure axis and a horizontal Time axis. These graphs 450 and 480 depict typical inflation and deflation cycles that occur from this alternative embodiment of micro air pump 330 of the present invention. Specifically, graph 450 depicts the pressure and timing of the air compressor-1 386 system (shown in FIG. 9) of micro air pump 330, and graph 480 depicts the pressure and timing of the air compressor-2 387 system (shown in FIG. 9). Graphs 450 and 480 are placed together and have the same timing signature for an easier temporal comparison.

Graph 450 includes a primary supply air pressure curve 452 which corresponds to the air provided by air compressor-1 386 of micro air pump 330 to flexible air supply tube 110 (shown in FIG. 8). This air supply begins at the start of the inflation cycle and rises to a preset, therapeutic air pressure 454. Similarly, graph 480 includes an air pressure curve 482 which corresponds to the air provided by air compressor-2 387 of micro air pump 330 to flexible air supply tube 310 (shown in FIG. 8). This air supply also begins at the start of an inflation cycle and rises to a preset, therapeutic air pressure 484.

Preset therapeutic air pressures 454 and 484 are approximately equal to maximum (MAX) desired pressures 456 and 486, and minimum (MIN) desired therapeutic pressures 455 and 485, respectively (shown by dashed lines). Pressures above MAX or below MIN levels will cause micro air pump 330 to signal an alarm of high or low pressure, respectively.

An absolute air pressure (ABS MAX) is an overall maximum pressure 468 and 498 (shown by dashed lines) that corresponds to an absolute maximum allowed pressure within deep vein thrombosis prevention garments 100 and 300, the maximum pressure medically safe, or any other maximum value utilized in the art to ensure safe operation of the micro air pump 330 of the present invention. ABS MAX 468 and 498 are air pressure set points above which the micro air pump 330 of the present invention signals an alarm of over pressure.

With dual garment mode selector switch 341 (shown in FIGS. 8-9) turned off to select single garment mode, the inflation/deflation cycle of the deep vein thrombosis prevention garment 100 follows the graph shown in FIG. 7.

When dual garment mode selector switch 341 is turned on to select dual garment mode the inflation and deflation of garments 100 and 300 proceed as follows. Inflation begins first with air compressor-1 386 and garment 100.

Looking at graph 450, the inflation cycle is completed once the deep vein thrombosis prevention garment 100 has had sufficient time to inflate, and is designated by time period 470. Following the inflation cycle, a delay may be inserted at the end of time period 470, as described in FIG. 7, but is not shown here.

Following inflation, the deflation cycle begins and the pressure 462 in the system of air compressor-1 386 and garment 100 decreases to zero during time period 472. Simultaneously, the system of air compressor-2 387 and garment 300 begins inflation as shown by curve 482 in graph 480. This inflation cycle is completed when air pressure in deep vein thrombosis prevention garment 300 reaches therapeutic level 484 at the end of time period 472.

When recirculation mode switch (RECIRC) 343 (shown in FIGS. 8-9) is on, a delay 473 in graph 450 occurs naturally between the end of garment 100 deflation and the beginning of the next inflation cycle shown by curve 453 in time period 474. This is due to the additional time required for air between the systems of air compressor-1 386 and air compressor-2 387 to equilibrate before inflation by air compressor-1 386 can begin again. When RECIRC switch 343 is off, a delay 473 does not occur, but may be inserted.

During time period 474, as garment 100 is in its next inflation cycle, garment 300 begins its deflation cycle and pressure 492 returns to zero. Again, a delay 476 occurs naturally if RECIRC switch 343 is turned on, or a delay 476 may have been programmed.

Figure 11:
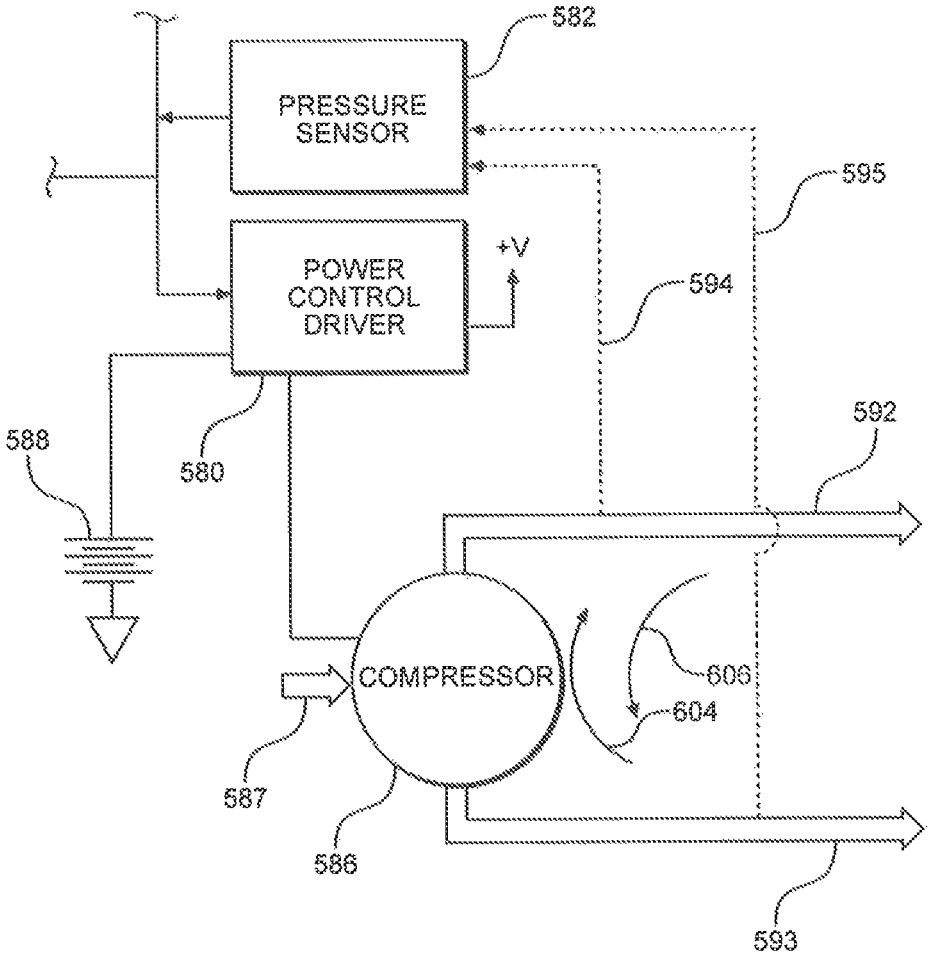
FIG. 11 is a partial exemplary operational diagram of the alternative embodiment of the micro air pump of the present invention reflecting a change to a subset of the operational diagram of the alternative embodiment of micro air pump in FIG. 9.

Referring to FIG. 11, a partial exemplary operational diagram of an alternative embodiment of the micro air pump 330 of the present invention is shown. FIG. 11 reflects a change to a subset of the operational diagram of the alternative embodiment of micro air pump 330 in FIG. 9. A single air compressor 586 is powered by a battery 588 through a power control driver 580. Compressor 586 outputs air to one (1) of two (2) air tubes 592 or 593 at a given time, enabling it to be used for pressurization of a single or dual deep vein thrombosis prevention garment system (not shown). Air tubes 592 and 593 feed air back to pressure sensor 582 through air tubes 594 and 595, respectively, for monitoring and control.

Compressor 586 is bi-directional, capable of drawing air from an air input 587 and outputting it to either air tube 592 or 593. It also routes pressurized air from one of the air tubes, which is de-pressurizing, into the opposite air tube, which is pressurizing, thus saving time and battery power.

In use, a user selects single garment mode or dual garment mode via dual garment mode selection switch 341 (shown in FIGS. 8-9). In single garment mode, during the inflation cycle, the compressor inputs air from air input 587 and outputs to air tube 592 in direction 604 for inflation of a garment 100 (not shown). Once the inflation cycle is completed and deflation of garment 100 begins, air travels in reverse direction 606 dissipating from compressor 586 through normal system bleeding.

In dual garment mode, compressor 586 inputs air initially from air input 587 and outputs it to air tube 592 in direction 604 for inflation of garment 100. Once the deflation cycle of garment 100 begins, air flows back through air tube 592 and through compressor 586 into air tube 593 in direction 606 to begin inflation of a garment 300 (not shown). Likewise, when the deflation cycle of garment 300 begins, air flows back through air tube 593 and through compressor 586 into air tube 592 in direction 604 to begin the next inflation cycle of garment 100. This recycling of pressurized air between the two (2) air tubes 592 and 593 results in decreased powering of compressor 586, and hence reduced power consumption from battery 588.

While there have been shown what are presently considered to be preferred embodiments of the present invention, it will be apparent to those skilled in the art that various changes and modifications can be made herein without departing from the scope and spirit of the invention.

We claim:

1. A portable micro air pump, comprising:

a body, a bi-directional air compressor within said body having a first air supply output port in fluid communication with a first pneumatic compression therapy garment, a second air supply output port in fluid communication with a second pneumatic compression therapy garment, and an air input port, said air compressor having a pump configured to force air out of and draw air into both said first and second air supply output ports;

a power source within said body in electrical communication with said air compressor;

a user-interface panel configured to receive input from a user;

a control circuit within said body in electrical communication with said air compressor, said user interface panel, and said power source; and wherein said control circuit is responsive to a first input from said user-interface panel and, in response to said first input, said control circuit generates one or more control signals directing said air compressor to:

force air out of said first supply output port and inflate said first pneumatic compression therapy garment; and draw air from said first pneumatic compression therapy garment into said first air supply output port to deflate said first pneumatic compression therapy garment and simultaneously force air out of said second air supply output port to inflate said second pneumatic compression therapy garment.

2. The portable micro air pump of claim 1, wherein the first and second pneumatic compression therapy garments further comprise an air chamber in fluid communication with said first and second air supply output ports respectively.

3. The portable micro air pump of claim 2, further comprising a flexible air supply tube between said first and second output ports and said air chambers.

4. The portable micro air pump of claim 1, further comprising a memory having data corresponding to the first and second pneumatic compression therapy garments.

5. The portable micro air pump of claim 1, wherein said user-interface panel further comprises a selection to utilize one or both of the first and second pneumatic compression therapy garments.

6. The portable micro air pump of claim 1, wherein said user-interface panel further comprises a power on/off switch.

7. The portable micro air pump of claim 1, wherein said user-interface panel further comprises a garment selection switch.

8. The portable micro air pump of claim 1, wherein said user-interface panel further comprises a plurality of status indicators.

9. The portable micro air pump of claim 1, wherein said user-interface panel further comprises alarm indicators comprising a first indicator configured to indicate a constant pressure or an over pressure condition, and a second indicator configured to indicate a low pressure or a high pressure condition.

10. The portable micro air pump of claim 1, further comprising a pressure sensor in electrical communication with said control circuit and in fluid communication with at least said first air supply output port.

11. The portable micro air pump of claim 1, further comprising means for providing a periodic air supply from said air compressor to said first or second pneumatic compression therapy garments.

12. The portable micro air pump of claim 1, configured to provide a peristaltic force on veins within a limb being treated.

13. The portable micro air pump of claim 1, further comprising means for deflating said first and second pneumatic compression therapy garments.

14. The portable micro air pump of claim 1, further comprising means for selectively inflating and deflating said first and second pneumatic compression therapy garments in accordance with a predetermined inflation and deflation cycle.

15. The portable micro air pump of claim 1, wherein the control circuit adjusts the air output of the air compressor through a power control driver to maintain programmed pressure settings.

16. The portable micro air pump of claim 9, wherein said first indicator illuminates as a solid light for a constant pressure condition and blinks if there is an over pressure condition.

17. The portable micro air pump of claim 9, wherein said second indicator illuminates as a solid light for a low pressure condition and blinks if there is a high pressure condition.

18. The portable micro air pump of claim 1, wherein the portable micro air pump deflates the first and second pneumatic therapy garments by bleeding air back through the air compressor and out the air input port.

19. A portable micro air pump, comprising a body;

a first bi-directional air compressor within said body and having a first air supply outlet port and a second air supply output port, the air compressor having a pump configured to force air out of and draw air into both the first and second air supply output ports;

a power source within said body in electrical communication with said air compressor;

a user-interface panel configured to receive input from a user;

a control circuit within said body in electrical communication with the first air compressor, the user interface panel, and the power source;

a dual garment mode selection button configured to activate and deactivate a dual garment mode; and an air recirculation button configured to activate and deactivate an air recirculation mode, wherein the portable micro air pump connects to a first pneumatic compression therapy garment through the first air supply outlet port and a second pneumatic compression therapy garment through the second air supply outlet port such that when the dual garment mode is selected, the control circuit generates one or more control signals directing the air compressor to:

inflates the first garment while simultaneously deflating the second garment, deflates the first garment while simultaneously inflating the second garment, and wherein activating the air recirculation mode causes the control circuit to generate one or more control signals directing the air compressor to:

recirculate air from a deflating pneumatic compression therapy garment through the compressor to an inflating pneumatic compression therapy garment.

* * * * *